US007648598B2

(12) United States Patent
Lee et al.

(10) Patent No.: US 7,648,598 B2
(45) Date of Patent: Jan. 19, 2010

(54) MANUFACTURING METHOD FOR ISOTHERMAL EVAPORATION CASTING PROCESS

(75) Inventors: Sheng-Long Lee, Jhongli (TW); Ten-Fu Wu, Taipei (TW); Jing-Chie Lin, Jhongli (TW); Che-Wei Hsu, Tainan (TW); Fu-Kai Hsu, Sanchong (TW); Cheng-En Jiang, Jhonghe (TW)

(73) Assignee: National Central University, Jhongli (TW)

( * ) Notice: Subject to any disclaimer, the term of this patent is extended or adjusted under 35 U.S.C. 154(b) by 505 days.

(21) Appl. No.: 11/584,847

(22) Filed: Oct. 23, 2006

(65) Prior Publication Data

US 2008/0093046 A1 Apr. 24, 2008

(51) Int. Cl.
*C22C 19/03* (2006.01)
*B22D 27/00* (2006.01)

(52) U.S. Cl. ..... 148/555; 164/57.1; 164/55.1

(58) Field of Classification Search ..... 148/555; 164/57.1

See application file for complete search history.

(56) References Cited

U.S. PATENT DOCUMENTS 3,367,771 A * 2/1968 Robertson et al. ..... 420/578
7,083,689 B2 * 8/2006 Park ..... 148/667
2008/0190244 A1 * 8/2008 Lee et al. ..... 75/406

FOREIGN PATENT DOCUMENTS

JP 09302436 A * 11/1997

OTHER PUBLICATIONS

Li et al, Hydrogen storage properties of Mg-23.3wt% Ni eutectic alloy prepared via hydroding combustion synthesis followed by mechanical milling, WHEC 16/13-16, Jun. 2006.*

* cited by examiner

*Primary Examiner*—Roy King
*Assistant Examiner*—Jie Yang
(74) *Attorney, Agent, or Firm*—C. G. Mersereau; Nikolai & Mersereau, P.A.

(57) ABSTRACT

A manufacturing method for an isothermal evaporation casting process is disclosed and to design the manufacturing method for the simple atmospheric casting. The present invention can melt the Mg—Ni alloy with the aspect of totally different melting points thereof, and the other elements can be added during melting simultaneously. Through the Mg—Ni alloy with a suitable weight ratio, the eutectic alloy of $Mg/Mg_2Ni$ and high purified γ-phase $Mg_2Ni$ can be made. Then adding other elements are to produce the composition of Mg/Ni/M. By way of the manufacturing method of the present invention, the melting equipment is simplified; and, through different manufacturing steps, the purposes of time-saving and low cost are reached; further that, a large amount of the eutectic alloy of $Mg/Mg_2Ni$ with different kinds of ratios of Mg, high purified γ-phase $Mg_2Ni$, or the composition of Mg/Ni/M can be obtained.

12 Claims, 8 Drawing Sheets

| EPMA Analysis（atom ratio） | |
|---|---|
| Mg | 67.3 |
| Ni | 32.7 |

MANUFACTURING METHOD FOR ISOTHERMAL EVAPORATION CASTING PROCESS

FIELD OF THE INVENTION

The present invention relates to a manufacturing method for an isothermal evaporation casting process, which adopts a smelting method to gain an eutectic Mg+$Mg_2Ni$ alloy, and then to evaporate magnesium to gain a purified hydrogen storage alloy of γ-phase $Mg_2Ni$.

BACKGROUND OF THE INVENTION

Some known sorts of metals have the characteristics of absorbing hydrogen and releasing hydrogen. Any of such metals absorbs hydrogen to become metal hydride; otherwise, hydrogen is released by the metal hydride, the metal hydride is back to the metal. For instance, the alloy of iron and titanium, the alloy of lanthanum and nickel, the alloy of magnesium and nickel, etc., those hydrogen storage alloys are found 1960-1970 of $20^{th}$ century.

The prior arts to manufacture a high purified $Mg_2Ni$ alloy are vacuum arc melting, induction melting, powder metallurgy, laminate rolling, mechanical alloying, rotation-cylinder method, etc. Such prior arts have the disadvantages of expensive equipment, a long period of manufacturing, a less quantity of output, etc. Further, eutectic Mg+$Mg_2Ni$ and γ-phase $Mg_2Ni$ are easily mixed each other during manufacturing processes. Therefore, the high purified γ-phase $Mg_2Ni$ is hardly to gained.

SUMMARY OF THE INVENTION

The primary objective of the present invention is to provide a new and simple manufacturing method for an isothermal evaporation casting process, which can melt the Mg—Ni alloy with the aspect of totally different melting points thereof, so both can combine to be an eutectic alloy of Mg and $Mg_2Ni$. The continuous step of evaporating magnesium is capable of rapidly and largely obtaining a purified blocked hydrogen storage alloy of γ-phase $Mg_2Ni$, and the microelement of M can be added either during melting. M may be aluminum, iron, zirconium, titanium, etc. to make the alloy be the compound of Mg/Ni/M. Wherein M is selected from the group of hydrogen storage compounds of Al, Fe, Zr, Ti, Cu, C, Pd, Pt, etc.

The alloy of magnesium and nickel is represented by the following chemical formula:

$$Mg_2Ni_y, \quad \text{I}$$

wherein the value of y is from 1, as $Mg_2Ni$, to 4, as $MgNi_2$.

From the aspect of absorbing hydrogen, the best metal ingredients of the formula I is $Mg_2Ni$. As a matter of fact, the highly purified $Mg_2Ni$ is hardly gained by way of melting. If the value of y is less than 1, thus the magnesium is excess so as to obtain the highly purified $Mg_2Ni$ by means of the present invention. Otherwise, if the value of y is more than 1, a problem in practice does exist. For instance, when the value of y is more than 2, not only the alloy of crystal $Mg_2Ni$ is formed, but also that the Laves-phase $MgNi_2$ is produced. Although $MgNi_2$ is capable of absorbing hydrogen, the amount of absorbing hydrogen by means of $MgNi_2$ is only 40~70% of the amount of absorbing hydrogen by means of $Mg_2Ni$. Therefore, the condition of the excess y is negative to the alloy derived by the present invention.

Please refer to FIG. 2, which illustrates a phase diagram. To produce the pure $Mg_2Ni$ alloy may be under the status of stable ingredients. That is, to be along the vertical line of $Mg_2Ni$ to cool down and condense may mold the pure $Mg_2Ni$ alloy. However, it is hard to precisely control the weight distribution of ingredients, so the pure $Mg_2Ni$ alloy is barely gained either. Further, while the melting liquid is concreted, the tiny effects of aliquation and unstable ingredients cannot be avoided so as to happen the condition of the $Mg_2Ni$ and the excess ingredients being eutectic. Taking the formula I to be as an example, the value of y less than 1 while in molding makes the $Mg_2Ni$ and the excess ingredients be eutectic at the last stage of cooling; otherwise, the $Mg_2Ni$ and the $Mg_2Ni_2$ or the $Mg_2Ni$, the $Mg_2Ni_2$, and the excess Ni are eutectic while the value of y is more than 1. While the $Mg_2Ni$ and Mg exist simultaneously, that is, the value of y is less than 1, the material has a better mechanical strength, but is with worse chemical stability and fragility. For the ingredients of $Mg_2Ni_y$, the ingredients for the value of y less than 1 are abandoned, but the scope of $1<y\leqq1.5$ is adopted.

Further, the time period of the melting liquid staying in the two-phase section is too short to have not enough time for forming the $Mg_2Ni$ after reacting magnesium and nickel. Hence, the producing amount of the $Mg_2Ni$ may be effected as well.

The manufacturing method disclosed by the present invention features that the melting environment does not need any vacuum equipment, and only needs a sealed room exposed in the atmosphere and protecting gas as inert gas. The inert gas can be argon, nitrogen, $SF_6$, etc., which has the characteristics of simple operating processes and easy control.

To increase the characteristic of the Mg—Ni alloy absorbing hydrogen, adding a third microelement M from some studies to reach the better effect of absorbing hydrogen. The composition of Mg, Ni, and M by adding the third microelement M can be represented as following chemical formula:

$$Mg_{2-x}NiM_x \text{ or } Mg_2Ni_{1-x}M_x \quad \text{II}$$

According to the formula II, the third microelement can replace Mg or Ni so as to have two representations for the produced compositions.

DETAILED DESCRIPTIONS OF THE PREFERRED EMBODIMENT

According to the dimensions of a furnace, having the suitable total weight of an alloy, raising the temperature of the furnace up to above the liquid phase line of the Mg—Ni equilibrium phase diagram of a specific weight ratio may melt the solid state of magnesium and nickel into the liquid phase, but the temperature range is between 507° C. to 900° C. Other elements can be added within the processes mentioned above, such as Al, Fe, Zr, Ti, Cu, C, Pd, Pt, etc. Continuously, to react magnesium and nickel in a two-phase section is to obtain $Mg_2Ni$. Then cooling down and re-raising the temperature for engaging the process of vaporizing Mg can acquire the $Mg_2Ni$ with high degree of purity or the composition of Mg/Ni/M.

Figure 1:
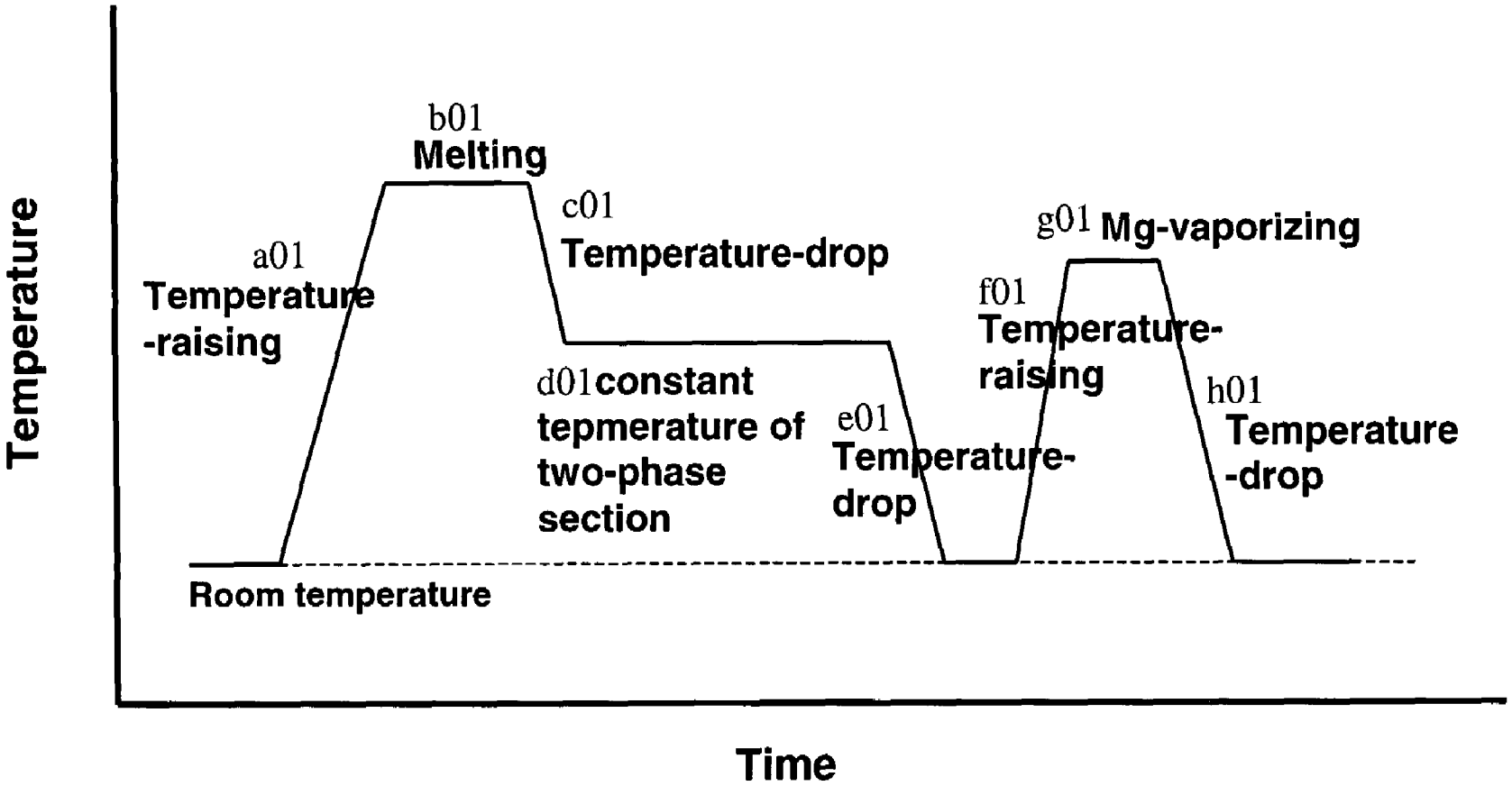
FIG. 1 illustrates a flow chart of a preferred embodiment of a manufacturing method for an isothermal evaporation casting process of the present invention.
Figure 2:
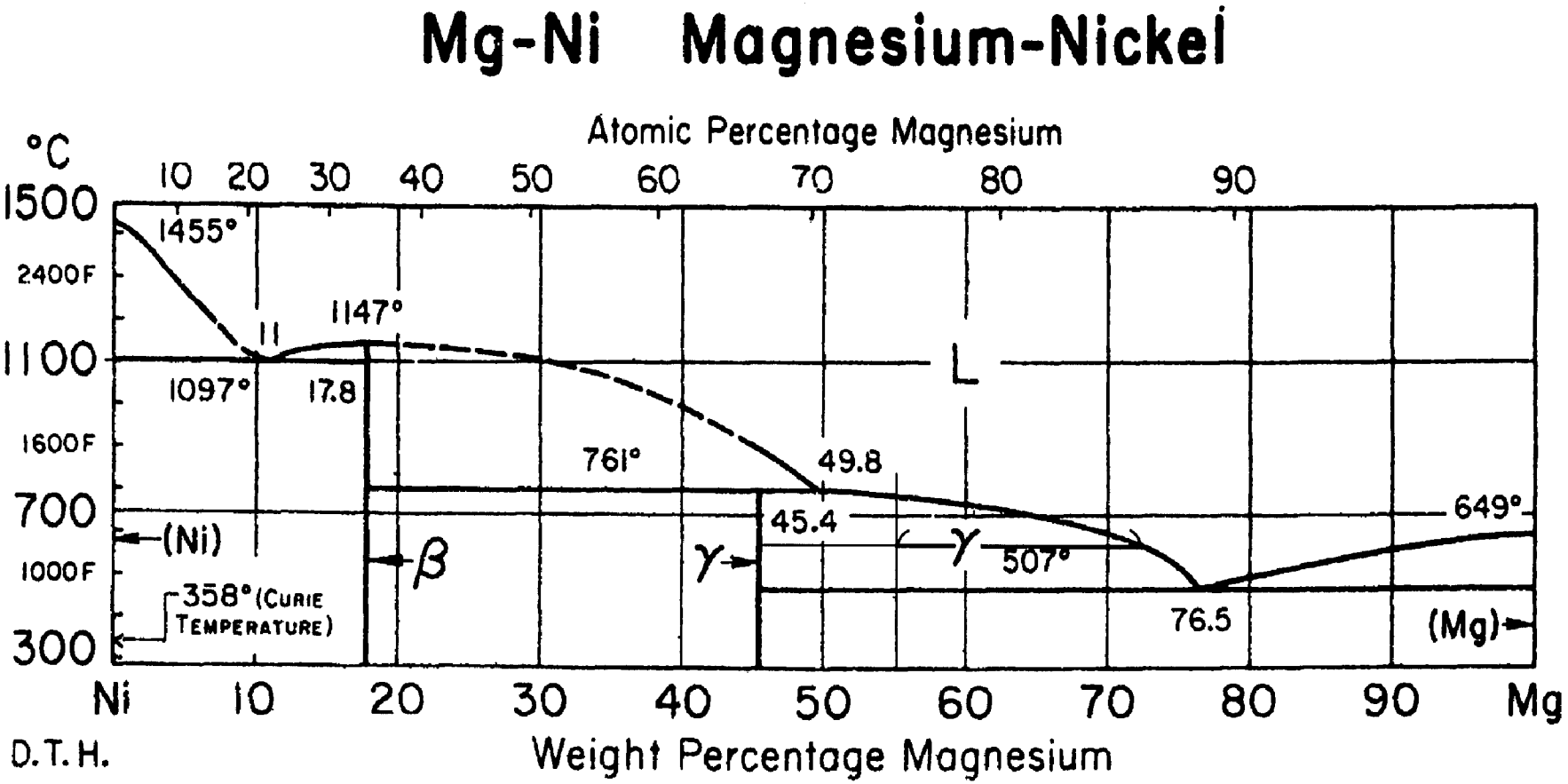
FIG. 2 illustrates a Mg—Ni equilibrium phase diagram.

There are a plurality of preferred embodiments for the present invention as shown below:

The first preferred embodiment is as follows:

The manufacturing method of the present invention shall refer to FIG. 1, and includes:

preparing a melting crucible, magnesium, nickel, refractory clay or soft ceramic, and protecting gas as inert gas, wherein the melting crucible can be stainless steel and with an upper cover, the upper cover is drilled a hole, the height of the upper cover and the dimensions of the melting pot let a mechanical stirring rod stir within the melting process and take off the liquid surface of the melted metals under the condition of sealing the melting pot; then taking the weight ratio of magnesium and nickel of the melting liquid as 50% to 50%, and putting it into the melting crucible, continuously sealing the melting crucible with refractory clay or soft ceramic and flowing the protecting gas into the melting pot for protection.

Figure 3:
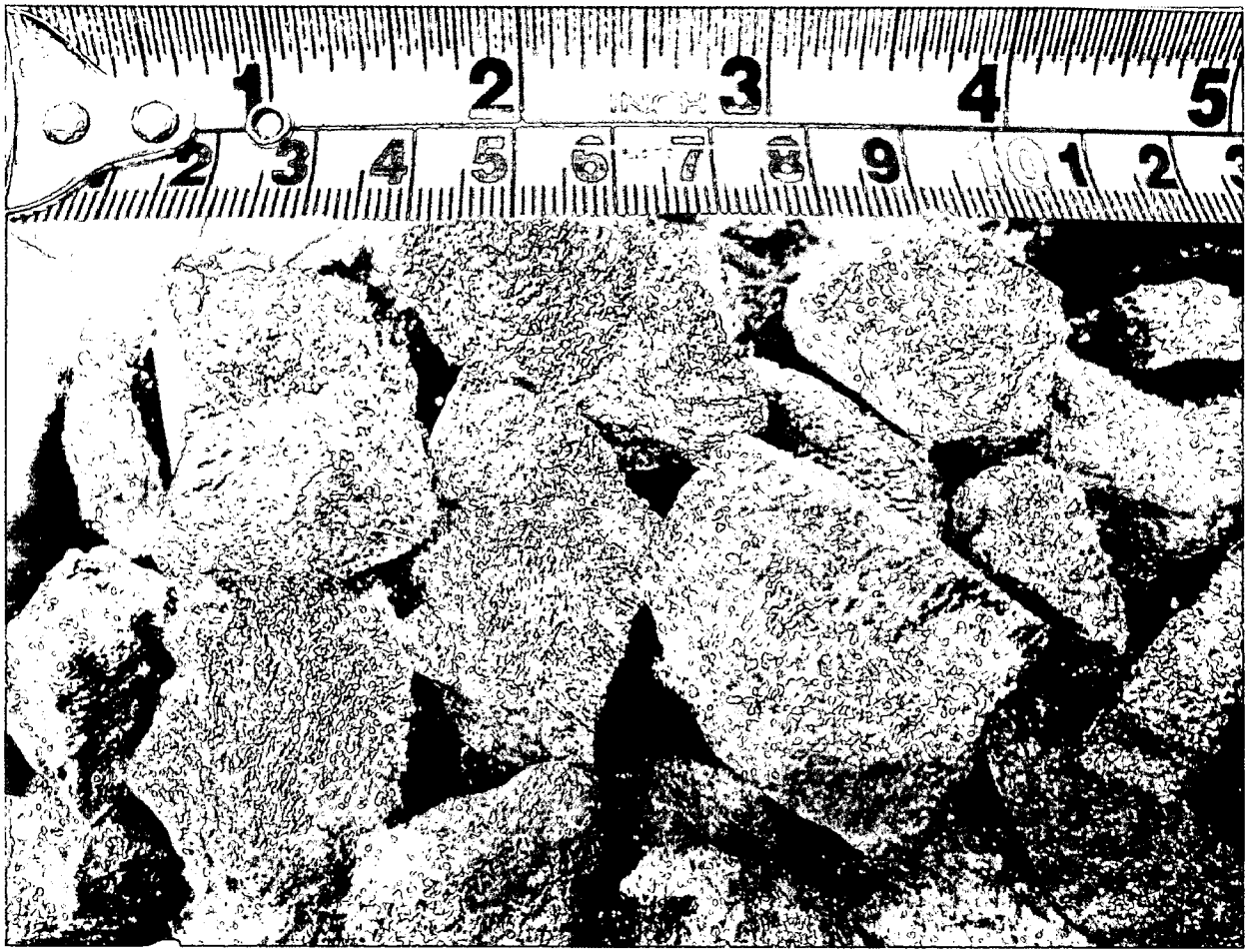
FIG. 3 illustrates a high purified $Mg_2Ni$ alloy produced by the present invention.

The method includes the steps of:

(a01) raising the temperature of the melting liquid to the melting temperature of magnesium and nickel, which is about 800° C.;

(b01) melting the magnesium and the nickel into the state of liquid, continuously stirring the liquid by way of mechanism, wherein the stirring rod is off the liquid to prevent that the melting metals are solidified thereon after the mechanism finishes the stirring;

(c01) lowering the temperature of the melting liquid down to the temperature of a two-phase region, which is between 510° C. to 650° C.;

(d01) maintaining a period of reacting time after the temperature of the two-phase region is reached, the period the reacting time is between 40 to 60 minutes;

(e01) re-lowering the temperature of the melting liquid down until that a block material of an alloy of primary $Mg_2Ni$ and eutectic $Mg+Mg_2Ni$ is made;

(f01) removing the block material to another sealed heating furnace for heating to the vaporizing temperature of the magnesium, which is about 700° C.;

(g01) the heating furnace being added a vapor-guiding apparatus so as to completely exhaust the magnesium of the block material by vaporizing for safety, to control the amount of the magnesium vapor being to control the residue amount of the magnesium in the eutectic $Mg+Mg_2Ni$;

(h01) lowering down the temperature of the block material without the magnesium after vaporizing, and gaining the primary $Mg_2Ni$ and the eutectic $Mg_2Ni$, wherein the $Mg_2Ni$ is a high purified alloy, as shown in FIG. 3.

Figure 4:
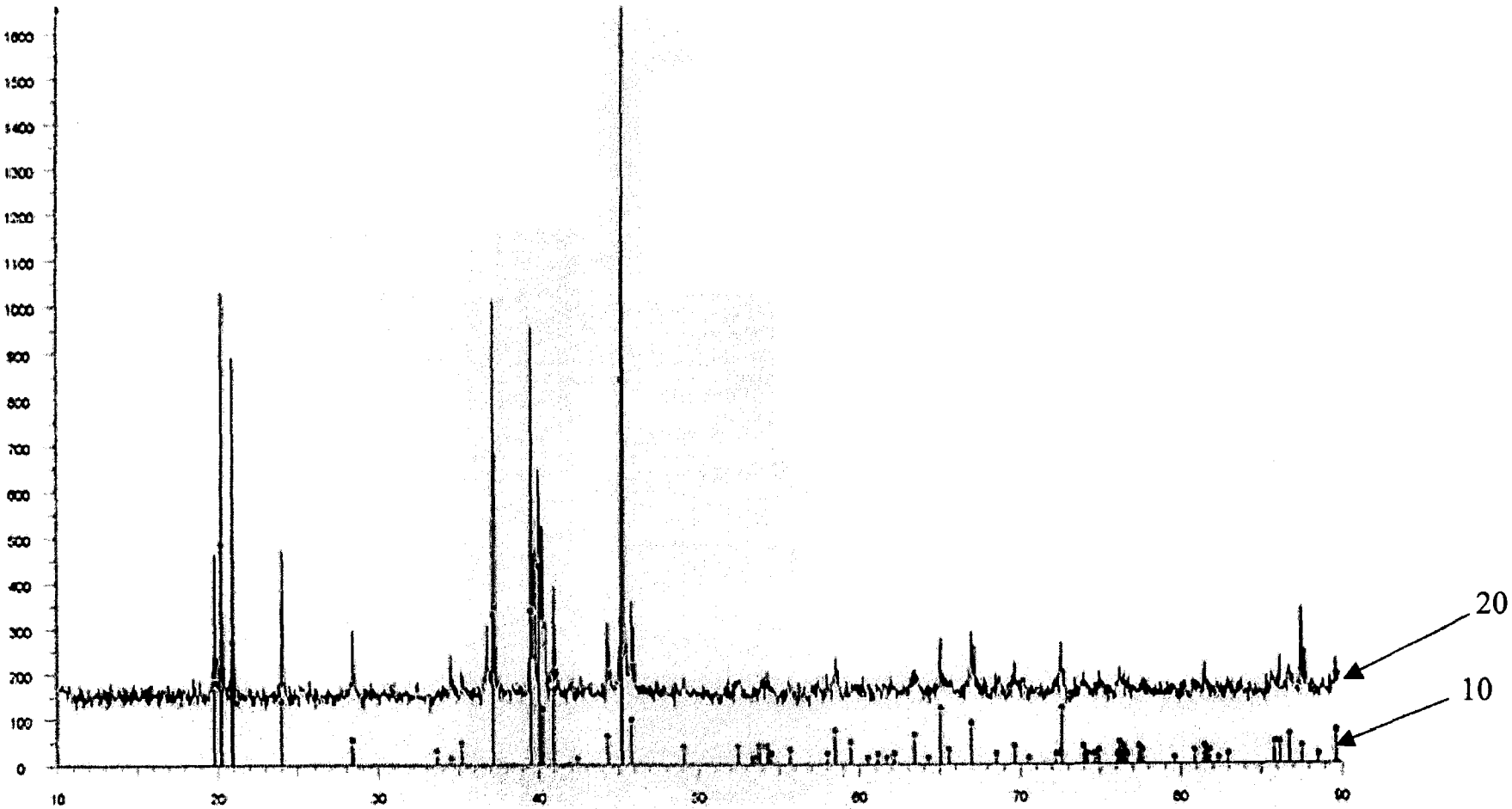
FIG. 4 illustrates the high purified $Mg_2Ni$ alloy analyzed by X-ray diffraction and shows the diffraction peaks of the $Mg_2Ni$.
Figure 5:
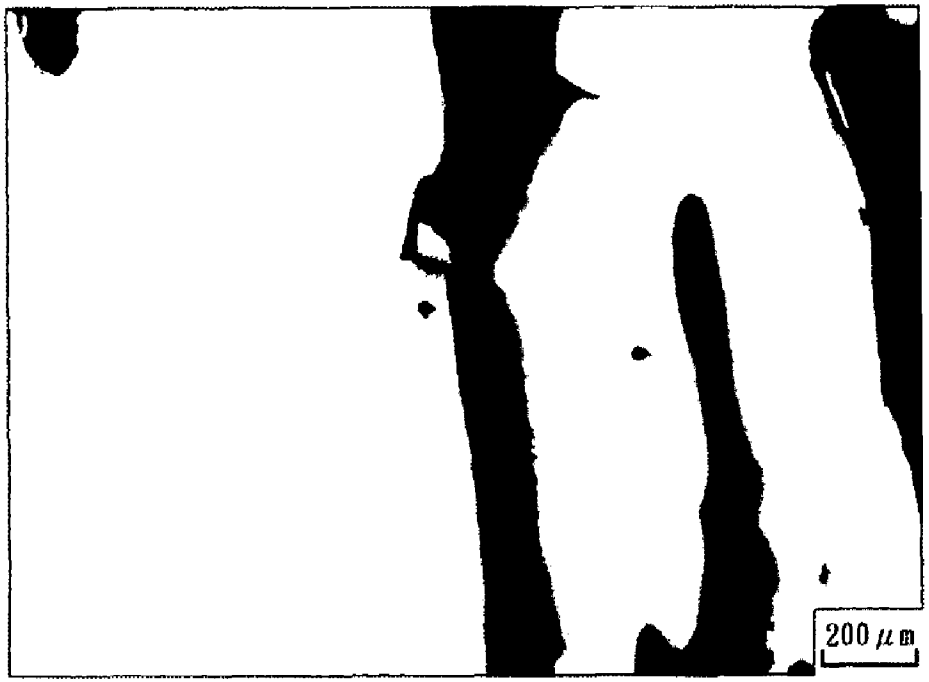
FIG. 5 illustrates the microstructure of a high purified $Mg_2Ni$ alloy, and the analyzed result by EPMA is $Mg_{67.3}Ni_{32.7}$.

A little powder of the $Mg_2Ni$ alloy is analyzed by X-ray diffraction, and the analyzing result is shown as FIG. 4. The diffraction peak 10 coincides with the $Mg_2Ni$ peak 20 in JCPD standard. Which means, the alloy is mainly composed of $Mg_2Ni$, and the $Mg_2Ni$ from the present invention is high degree of purity. For further assuring the ratio of the composition, the alloy can be analyzed by EPMA, the composed ratio of Mg atom and Ni atom is $Mg_{67.3}Ni_{32.7}$, as shown in FIG. 5. That is, the highly purified $Mg_2Ni$ is produced successfully.

Figure 6:
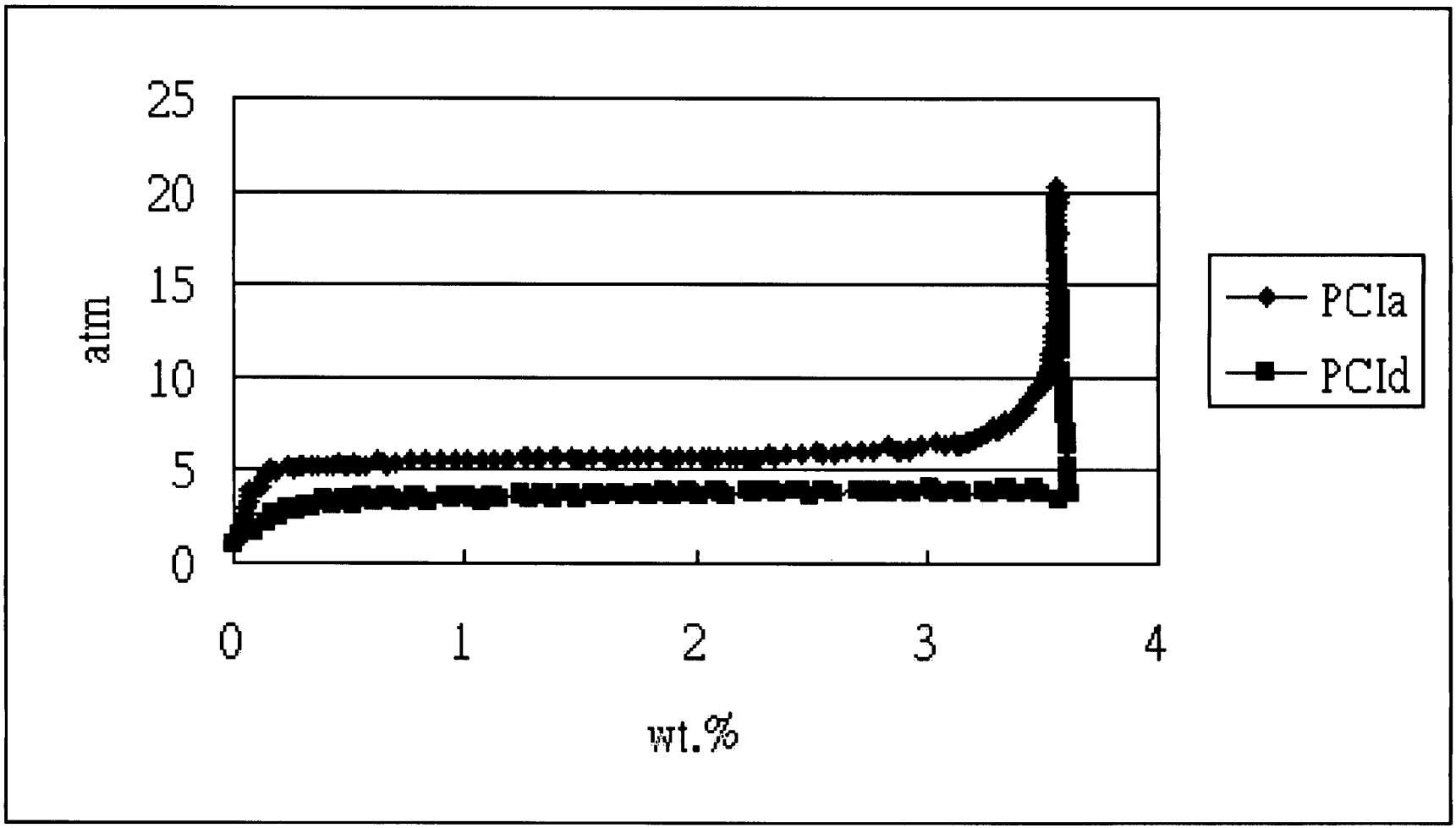
FIG. 6 illustrates the specific curves of absorbing and releasing hydrogen of the block high purified $Mg_2Ni$ alloy, the specific curves are determined by PCI.

Constantly, the $Mg_2Ni$ is engaged with the test of absorbing and releasing hydrogen. The test adopts PCI to gain the specific curves of absorbing and releasing hydrogen, as shown in FIG. 6. Wherein the maximum amount of absorbing hydrogen of the $Mg_2Ni$ is about 3.5 wt. %, which is the same as reference. Therefore, the alloy of Mg and Ni is truly $Mg_2Ni$.

Figure 7:
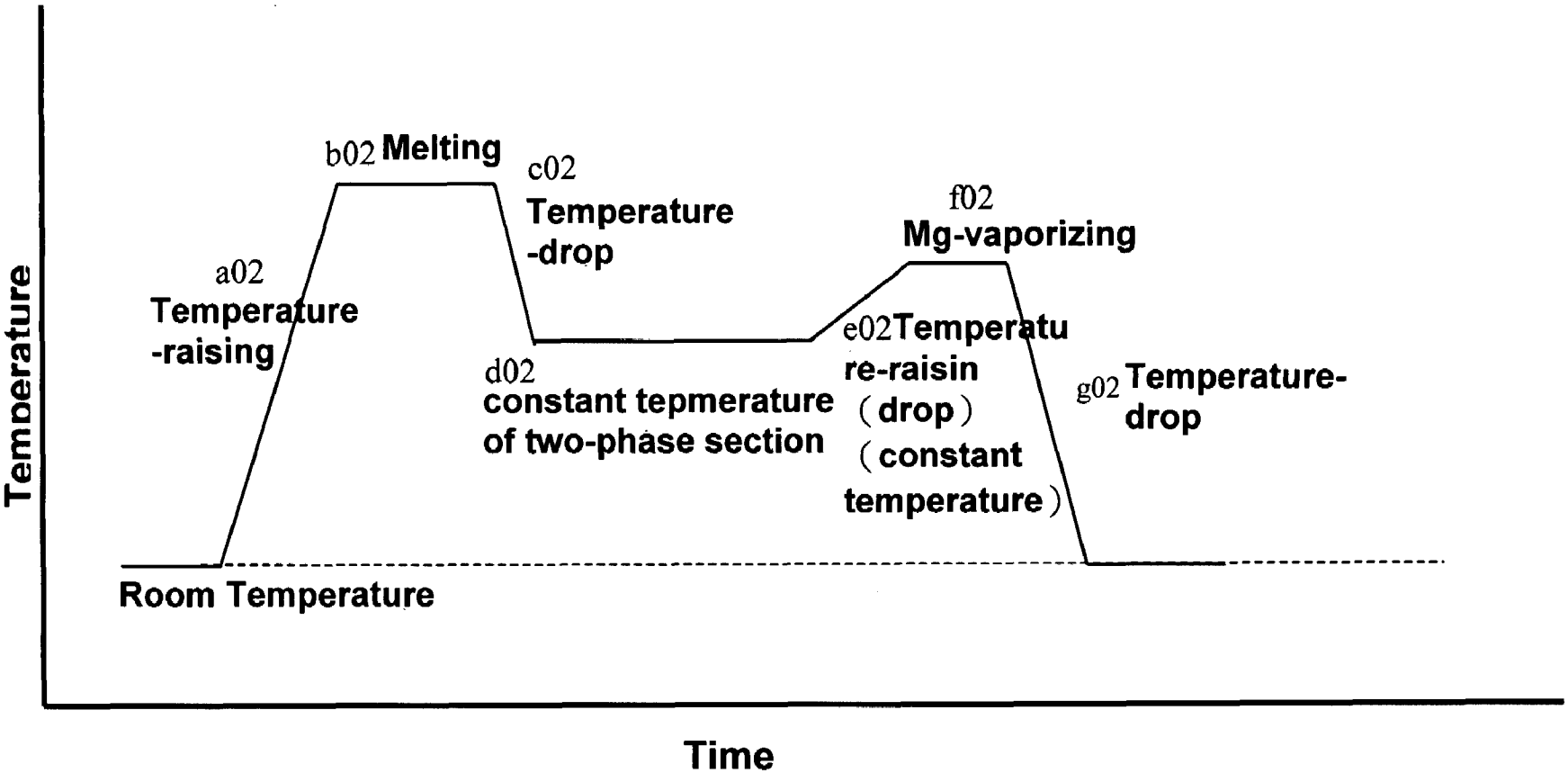
FIG. 7 illustrates a flow chart of another preferred embodiment of the manufacturing method for the isothermal evaporation casting process of the present invention.

The second preferred embodiment is as follows:

The second preferred embodiment discloses the manufacturing method for saving a few steps, as shown in FIG. 7, and includes the steps of:

(a02) raising the temperature of the melting liquid to the melting temperature of magnesium and nickel, which is about 800° C.;

(b02) melting the magnesium and the nickel into the state of liquid, continuously stirring the liquid by way of mechanism, wherein the stirring rod is off the liquid to prevent that the melting metals are solidified thereon after the mechanism finishes the stirring;

(c02) lowering the temperature of the melting liquid down to the temperature of a two-phase region, which is between 510° C. to 650° C.;

(d02) maintaining a period of reacting time after the temperature of the two-phase section is reached, the period the reacting time is between 40 to 60 minutes;

(e02) heating to the vaporizing temperature of the magnesium, which is about 700° C.;

(f02) maintaining the vaporizing temperature of the magnesium for a period of time, wherein the period of time is about 2 hours;

(g02) opening a sealed furnace as a heating furnace, the heating furnace being added a vapor-guiding apparatus so as to completely exhaust the magnesium of the block material by vaporizing for safety, to control the amount of the magnesium vapor being to control the residue amount of the magnesium in the eutectic $Mg+Mg_2Ni$;

(h02) lowering down the temperature of the block material without the magnesium after vaporizing, and gaining the $Mg_2Ni$, wherein the $Mg_2Ni$ is a high purified alloy.

With the above X-ray diffraction analysis and EPMA, the resulted alloy is pure $Mg_2Ni$. The compositions of EPMA are listed as the following table:

| | $1^{st}$ point | $2^{nd}$ point | $3^{rd}$ point |
|---|---|---|---|
| | Mass % | | |
| Mg | 45.968 | 45.906 | 46.425 |
| Ni | 54.457 | 53.671 | 54.304 |

-continued

| | 1st point | 2nd point | 3rd point |
|---|---|---|---|
| | Atomic % | | |
| Mg | 67.0774 | 67.3475 | 67.3601 |
| Ni | 32.9040 | 32.6035 | 32.6254 |

Figure 8:
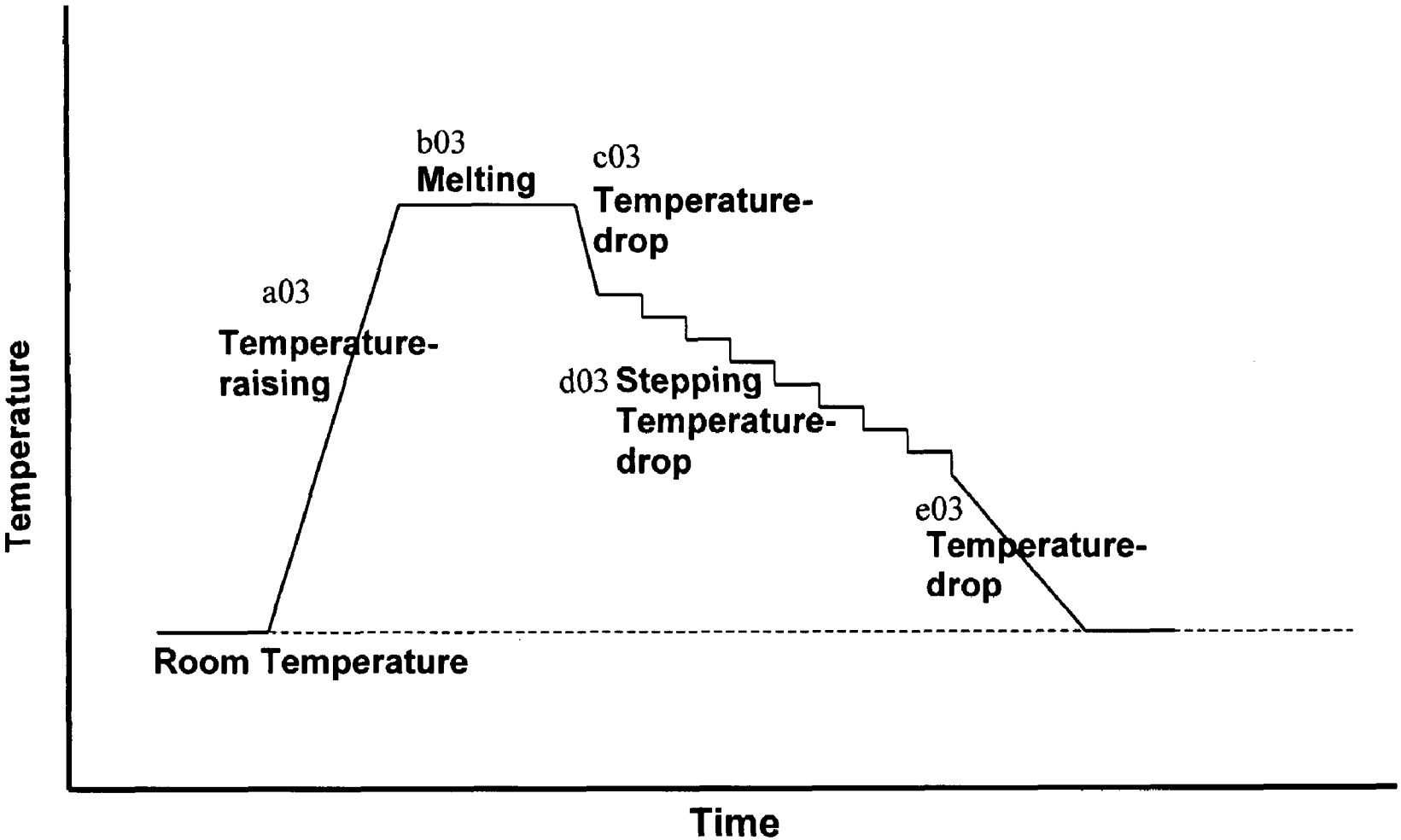
FIG. 8 illustrates a flow chart of another preferred embodiment of the manufacturing method for the isothermal evaporation casting process of the present invention.

The third preferred embodiment is as follows:

With reference to FIG. 8, which is the third preferred embodiment of the present invention for saving more steps of the manufacturing method.

The heating furnace is added a vapor-guiding apparatus so as to completely exhaust the magnesium of the block material by vaporizing for safety, and to control the amount of the magnesium vapor is to control the residue amount of the magnesium in the eutectic $Mg+Mg_2Ni$.

The third preferred embodiment includes the steps of:

(a03) raising the temperature of the melting liquid to the melting temperature of magnesium and nickel, which is about 800° C.;

(b03) melting the magnesium and the nickel into the state of liquid, continuously stirring the liquid by way of mechanism, wherein the stirring rod is off the liquid to prevent that the melting metals are solidified thereon after the mechanism finishes the stirring;

(c03) lowering the temperature of the melting liquid down to 750° C.;

(d03) adopting the way of stepping temperature-drop from 750° C., and each period of dropped temperature being maintained for a period of time, wherein one period of dropped temperature is about 10° C. and one period of time is about 10 minutes; and (e03) directly lowering down to a room temperature while the dropped temperature approaches to 510° C.

The purpose of the third preferred embodiment is to produce $Mg_2Ni$ by the reaction of Mg and Ni at the time of stepping temperature-drop; simultaneously, the additional magnesium is vaporized in order to produce the pure $Mg_2Ni$. Thereafter, the cooled alloy is analyzed by the X-ray diffraction analysis and EPMA and then approved. That is, the alloy is composed of pure $Mg_2Ni$.

The fourth preferred embodiment is as follows:

The fourth preferred embodiment adopts the steps of the first preferred embodiment, but adding a microelement as aluminum into the alloy of Mg and Ni. Then a melting pot is prepared in advance, wherein the melting crucible can be stainless steel and with an upper cover, the upper cover is drilled a hole, the height of the upper cover and the dimensions of the melting pot let a mechanical stirring rod stir within the melting process and take off the liquid surface of the melted metals under the condition of sealing the melting pot.

The weight ratio of Ni is a fixed value of 45 wt. %, others are Mg and Al. The weight ratio of Al is increased from 0 to 4 wt. %, the rest is Mg. The compositions of the alloy of Mg, Ni, and Al are listed as the following table:

| | Mg | Ni | Al |
|---|---|---|---|
| Weight ratio before melting | 55% | 45% | 0 |
| Weight ratio before melting | 54.5% | 45% | 0.5% |
| Weight ratio before melting | 54% | 45% | 1% |
| Weight ratio before melting | 53% | 45% | 2% |
| Weight ratio before melting | 51% | 45% | 4% |

The dispensed alloy is put into the pre-prepared melting crucible, continuously sealing the melting pot with refractory clay or soft ceramic and flowing the protecting gas into the melting pot for protection, where the protecting gas is argon. Then the temperature of the melting liquid is raised up to 800° C. so as to let Ni and Mg be in the state of liquid, the mechanical stirring rod is stirring within the melting process and taken off the liquid surface of the melted metals to prevent that the melting metals are solidified thereon after the mechanism finishes the stirring. The temperature of the melting liquid is lowered down to the temperature of the two-phase region, which is between 510° C. to 650° C. A period of reacting time is maintained after the temperature of the two-phase region is reached, the period the reacting time is between 40 to 60 minutes. The temperature of the melting liquid is re-lowered down to a room temperature until that a block material of an alloy is made.

The block material is removed to another sealed heating furnace for heating to the vaporizing temperature of the magnesium, which is 700° C. The heating furnace is added a vapor-guiding apparatus so as to completely exhaust the magnesium of the block material by vaporizing for safety. The temperature of the block material without the magnesium after vaporizing is lowered down again, and thus a block alloy is gained. The alloy can be analyzed by EPMA and ICP to assure that the composition of $Mg/Mg_2Ni/Al$ is formed.

The fifth preferred embodiment is as follows:

The fifth preferred embodiment adopts the steps of the first preferred embodiment, but adding an element as copper into the alloy of Mg and Ni. Then a melting crucible is prepared in advance, wherein the melting crucible can be stainless steel and with an upper cover, the upper cover is drilled a hole, the height of the upper cover and the dimensions of the melting pot let a mechanical stirring rod stir within the melting process and take off the liquid surface of the melted metals under the condition of sealing the melting pot.

The weight ratio of Mg, Ni, and Cu is 55 wt. %:43 wt. %:2 wt. %. The dispensed alloy is put into the pre-prepared melting crucible, continuously sealing the melting pot with refractory clay or soft ceramic and flowing the protecting gas into the melting pot for protection, where the protecting gas is argon. Then the temperature of the melting liquid is raised up to 800° C. so as to let Ni and Mg be in the state of liquid, the mechanical stirring rod is stirring within the melting process and taken off the liquid surface of the melted metals to prevent that the melting metals are solidified thereon after the mechanism finishes the stirring. The temperature of the melting liquid is lowered down to the temperature of the two-phase region, which is between 510° C. to 650° C. A period of reacting time is maintained after the temperature of the two-phase region is reached, the period the reacting time is between 40 to 60 minutes. The temperature of the melting liquid is re-lowered down to a room temperature until that a block material of an alloy is made.

The block material is removed to another sealed heating furnace for heating to the vaporizing temperature of the magnesium, which is 700° C. The heating furnace is added a vapor-guiding apparatus so as to completely exhaust the magnesium of the block material by vaporizing for safety. The temperature of the block material without the magnesium after vaporizing is lowered down again, and thus a block alloy is gained. The alloy can be analyzed by EPMA and ICP to assure that the composition of $Mg/Mg_2Ni/Al$ is formed.

While the present invention has been particularly shown and described with reference to the preferred embodiments, it will be understood by those skilled in the art that various changes in form and detail may be without departing from the spirit and scope of the present invention.

What is claimed is:

1. A manufacturing method for an isothermal evaporation casting process, comprising the steps of:

(a) raising the temperature of a melting crucible to the melting temperature of magnesium and nickel;

(b) melting the magnesium and the nickel into the state of liquid, continuously and averagely stirring the liquid;

(c) lowering the temperature of the melting liquid down to the temperature of a two-phase region;

(d) maintaining a period of reacting time after the temperature of the two-phase section is reached;

(e) re-lowering the temperature of the melting liquid down until that a block material of an alloy of primary $Mg_2Ni$ and eutectic $Mg+Mg_2Ni$ is made;

(f) removing the block material to another heating furnace for heating to the vaporizing temperature of the magnesium;

(g) evaporating the magnesium from the block material by way of the heating furnace continuously heating up;

(h) lowering down the temperature of the block material without the magnesium, and gaining the primary $Mg_2Ni$ and the eutectic $Mg_2Ni$, wherein the $Mg_2Ni$ is a high purified alloy; and wherein in step (g) the heating furnace includes a vapor-guiding apparatus, to control the amount of magnesium vapor to control the residue amount of magnesium in the eutectic $Mg+M_2Ni$.

2. The manufacturing method for the isothermal evaporation casting process according to claim 1, wherein the magnesium and the nickel are defined from the group of: pure powder magnesium and nickel, pure block magnesium and nickel, and the combination thereof.

3. The manufacturing method for the isothermal evaporation casting process according to claim 1, wherein the step of adding other elements is inserted between the step (a) and the step (b), that is, the elements M are added to let the alloy be the compound of $Mg/Mg_2Ni/M$, the elements M are selected from the group of aluminum, iron, zirconium, titanium, copper, carbon, palladium, platinum, and cobalt.

4. The manufacturing method for the isothermal evaporation casting process according to claim 1, wherein the steps of (a) to (e) are processed in the sealed melting crucible, which is full of protecting gas, the sealed melting crucible is exposed in the atmosphere.

5. The manufacturing method for the isothermal evaporation casting process according to claim 1, wherein stirring is performed in (b) by way of a technique selected from the group consisting of mechanism, electromagnet, or the combination thereof, a stirring rod being lifted from the liquid to prevent that the melting metals are solidified thereon after the mechanism finishes the stirring to prevent it from being caught in solidified metals.

6. The manufacturing method for the isothermal evaporation casting process according to claim 4, wherein the protecting gas is selected from the group of the inert gas of argon, nitrogen, and $SF_6$.

7. A manufacturing method for an isothermal evaporation casting process, comprising the steps of:

(a) raising the temperature of a melting crucible to the melting temperature of magnesium and nickel;

(b) melting the magnesium and the nickel into the state of liquid, continuously and averagely stirring the liquid;

(c) lowering the temperature of the melting liquid down to the temperature of a two-phase region;

(d) maintaining a period of reacting time after the temperature of the two-phase region is reached;

(e) heating the temperature of the melting liquid up to the vaporizing temperature of the magnesium;

(f) maintaining a period of time for the vaporizing temperature of the magnesium;

(g) evaporating the magnesium of a block material in a heating furnace;

(h) lowering down the temperature of the block material, and then removing the block material out of the heating furnace to gain the high purified $Mg_2Ni$ alloy; and wherein in step (g) the heating furnace includes a vapor-guiding apparatus, to control the amount of magnesium vapor to control the residue amount of magnesium in the eutectic $Mg+M_2Ni$.

8. The manufacturing method for the isothermal evaporation casting process according to claim 7, wherein the magnesium and the nickel are defined from the group of: pure powder magnesium and nickel, pure block magnesium and nickel, and the combination thereof.

9. The manufacturing method for the isothermal evaporation casting process according to claim 7, wherein the step of adding other elements is inserted between the step (a) and the step (b), that is, the elements M are added to let the alloy be the compound of $Mg/Mg_2Ni/M$, the elements M are selected from the group of aluminum, iron, zirconium, titanium, copper, carbon, palladium, platinum, and cobalt.

10. The manufacturing method for the isothermal evaporation casting process according to claim 7, wherein the steps of (a) to (h) are processed in the sealed melting crucible, which is full of protecting gas, the sealed melting crucible is exposed in the atmosphere.

11. The manufacturing method for the isothermal evaporation casting process according to claim 7, wherein stirring is performed in (b) by way of a technique selected from the group consisting of mechanism, electromagnet, or the combination thereof, a stirring rod being lifted from the liquid to prevent that the melting metals are solidified thereon after the mechanism finishes the stirring to prevent it from being caught in solidified metals.

12. The manufacturing method for the isothermal evaporation casting process according to claim 10, wherein the protecting gas is selected from the group of the inert gas of argon, nitrogen, and $SF_6$.

* * * * *